US007044360B2

(12) United States Patent
Campbell

(10) Patent No.: US 7,044,360 B2
(45) Date of Patent: May 16, 2006

(54) UPBOX / RC

(76) Inventor: Roger Alan Campbell, #40 Hillside Terrace, Moose Lake, MN (US) 55767

( * ) Notice: Subject to any disclaimer, the term of this patent is extended or adjusted under 35 U.S.C. 154(b) by 0 days.

(21) Appl. No.: 10/965,556

(22) Filed: Oct. 14, 2004

(65) Prior Publication Data

US 2006/0081694 A1 Apr. 20, 2006

(51) Int. Cl.
*A47G 29/12* (2006.01)

(52) U.S. Cl. ..... 232/17; 232/45

(58) Field of Classification Search ..... 232/17, 232/45, 28, 29, 33
See application file for complete search history.

(56) References Cited

U.S. PATENT DOCUMENTS 736,815 A * 8/1903 Brown ..... 232/17
1,839,834 A * 1/1932 Coleman ..... 232/28
2,561,007 A * 7/1951 Bierig ..... 232/17
2,827,228 A * 3/1958 Wikert ..... 232/35
3,946,939 A * 3/1976 Schifman ..... 232/17
4,650,113 A * 3/1987 Hunt ..... 232/17
5,460,325 A * 10/1995 Surman ..... 232/17

* cited by examiner

*Primary Examiner*—William L. Miller

(57) ABSTRACT

The present invention provides an improved rural mailbox apparatus. In one embodiment, the apparatus comprises a lower housing and an upper, pivotally mounted upper shell. The lower housing has an opening for passing mail into and out of the housing. The upper shell is pivotally connected to the lower housing with the upper shell being vertically and rotatably moveable between a lowered, closed position and an upper, open position. In the lowered, closed position, the shell sufficiently covers the housing opening to protect contained mail from normal environmental conditions. When the shell is in the upper, open position, access is provided for a user to deposit mail into or extract mail out of the housing.

6 Claims, 2 Drawing Sheets

TECHNICAL FIELD

This disclosure relates generally to containers and in particular to an improved, upward-opening mailbox apparatus.

BACKGROUND

Mailboxes generally are of two types, the urban mailbox and the rural mailbox. Urban mailboxes are those types of mailboxes which are physically attached to the dwelling units they service. Rural mailboxes are those types of mailboxes, which are free standing, essentially physically separate from the dwelling units they service. Rural mailboxes usually have the shape of oblong boxes with rounded tops and are mounted on posts very close to the side of the roads in front of the houses that they service. The rural freestanding mailboxes serve multiple purposes, in particular they are used to deposit mail in as well as to identify the property location associated with the mailbox. Rural mailboxes generally have outward opening doors, which in connection with the proximity of the mailboxes to the edge of the road, allows the mail carrier to conveniently deposit mail in the rural mailbox without getting out of the vehicle. Unfortunately, while this configuration is convenient for the mail carrier, the outward opening door is susceptible to being torn away by a vehicle that is too close to the mailbox. Similarly, if the carrier (or resident) stops too closely to the mailbox, the outward opening door may not fully open for removing or depositing mail. Moreover, such outward opening doors can inadvertently open, e.g., from the wind and allow rain or snow to enter the mailbox and damage its contents.

Accordingly, what is needed is an improved mailbox apparatus.

SUMMARY

The present invention provides an improved rural mailbox apparatus. In one embodiment, the apparatus comprises a lower housing and an upper, pivotally mounted upper shell. The lower housing has an opening for passing mail into and out of the housing. The upper shell is pivotally connected to the lower housing with the upper shell being vertically and rotatably moveable between a lowered, closed position and an upper, open position. In the lowered, closed position, the shell sufficiently covers the housing opening to protect contained mail from normal environmental conditions. When the shell is in the upper, open position, access is provided for a user to deposit mail into or extract mail out of the housing.

The foregoing has outlined rather broadly some of the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes as the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, the following description is made with reference to the accompanying drawings, in which.

DETAILED DESCRIPTION

The present invention provides a unique solution to the problems associated with conventional rural mailboxes. Instead of utilizing an outward opening door, the various embodiments employ an upward opening shell, which allows users to get closer to the mailbox when opening it and is much less susceptible of opening inadvertently and thereby is able to keep out snow and rain.

Figure 1:
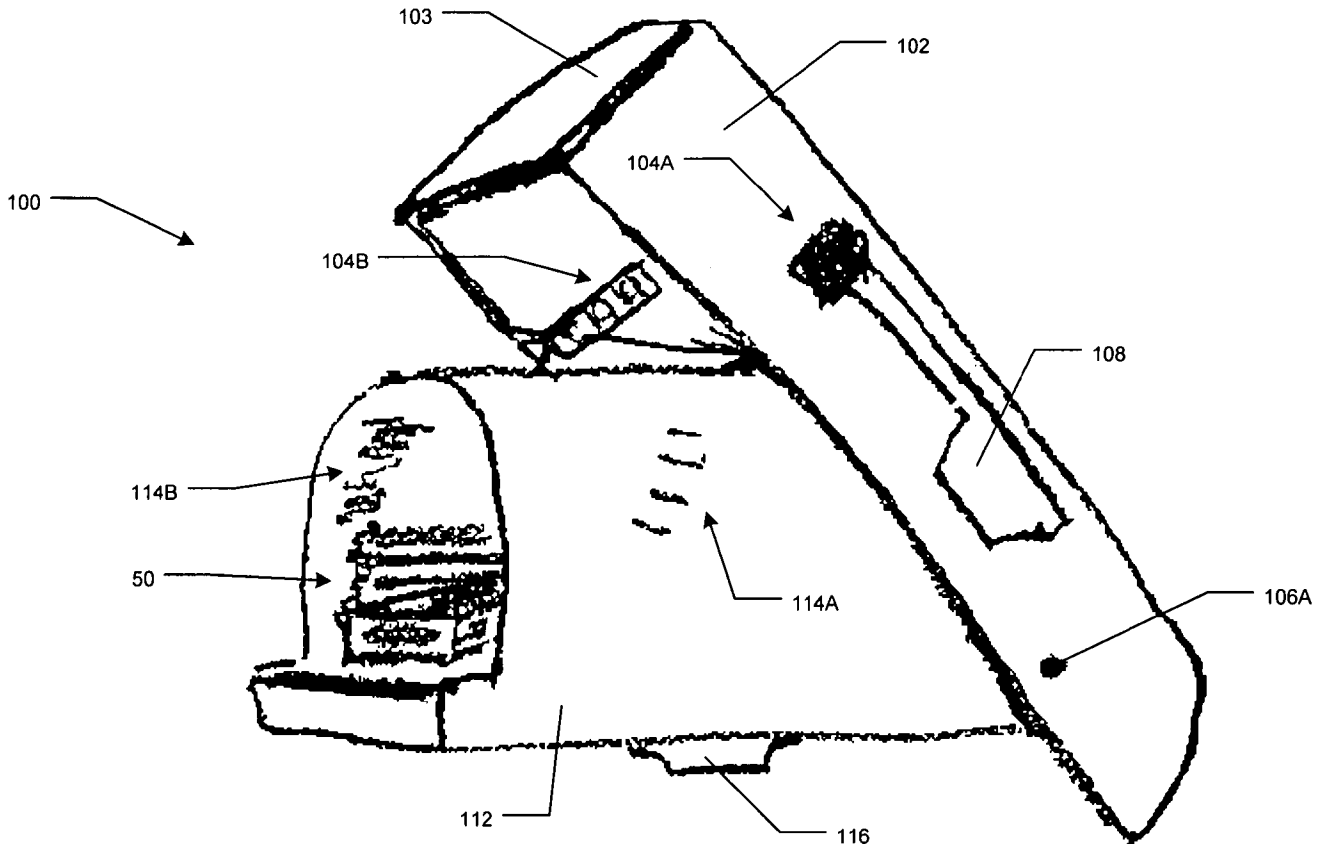
FIG. 1 shows a perspective view of an upward opening mailbox according to one embodiment of the present invention.

FIG. 1 shows an embodiment of an upward opening mailbox 100. It generally includes a moveable upper shell 102 pivotally connected to lower box housing 112. Lower box housing 112 has front opening 50 for inserting and removing mail, along with a mount 116 for connection to a suitable post or the like. Upper shell 102 has a front closed portion 103 for sealing opening 50 closed when the mailbox 100 is closed, i.e., when the upper shell 102 is in a lowered, closed position. Also shown in this embodiment is a conventional flag member 108, pivotally connected to upper shell 102, for indicating whether or not mail has been delivered.

A first pivot connection 106A and a second pivot connection (not shown) across from the first pivot connection pivotally connect the upper shell to the lower housing 102. A pivot connection can be implemented with any suitable scheme. In the depicted embodiment, mail protrusions extend inwardly from the interior of upper shell 102 and are received by appropriately aligned openings or wells for pivotally mounting the shell 102 to the housing 112 in a stable manner. However, any suitable scheme could be employed including a single connection, as opposed to the spaced apart first and second connections shown in the figure.

The lower housing 112 further has outwardly facing ribs (or ridges) 114 A, 114B that work in cooperation with inwardly projecting ribs 104A, 104B, which extend inwardly from the interior of upper shell 102, to serve as position holding devices. That is, they work together to maintain the upper shell in a stable position, regardless of whether it is opened or closed. The ribs (or ridges) are shaped and protrude sufficiently to allow a user to readily open and close the upper shell, but at the same time, maintain the upper shell open when mail is being deposited or withdrawn and maintain it closed when exposed to the elements under normal conditions. While horizontal ribs are used in this embodiment, any suitable configuration of protrusions, detents, frictional device, or the like could also be used for achieving this purpose. In addition, in the depicted embodiment, separate sets on either side of the mailbox are used, but in other embodiments, one or multiple sets could be used.

Both the lower housing 102 and upper shell are constructed from suitable materials such as aluminum, molded plastic, rubber, or the like. They may each be formed from a unitary structure or alternatively, they could be assembled using multiple components.

Figure 2:
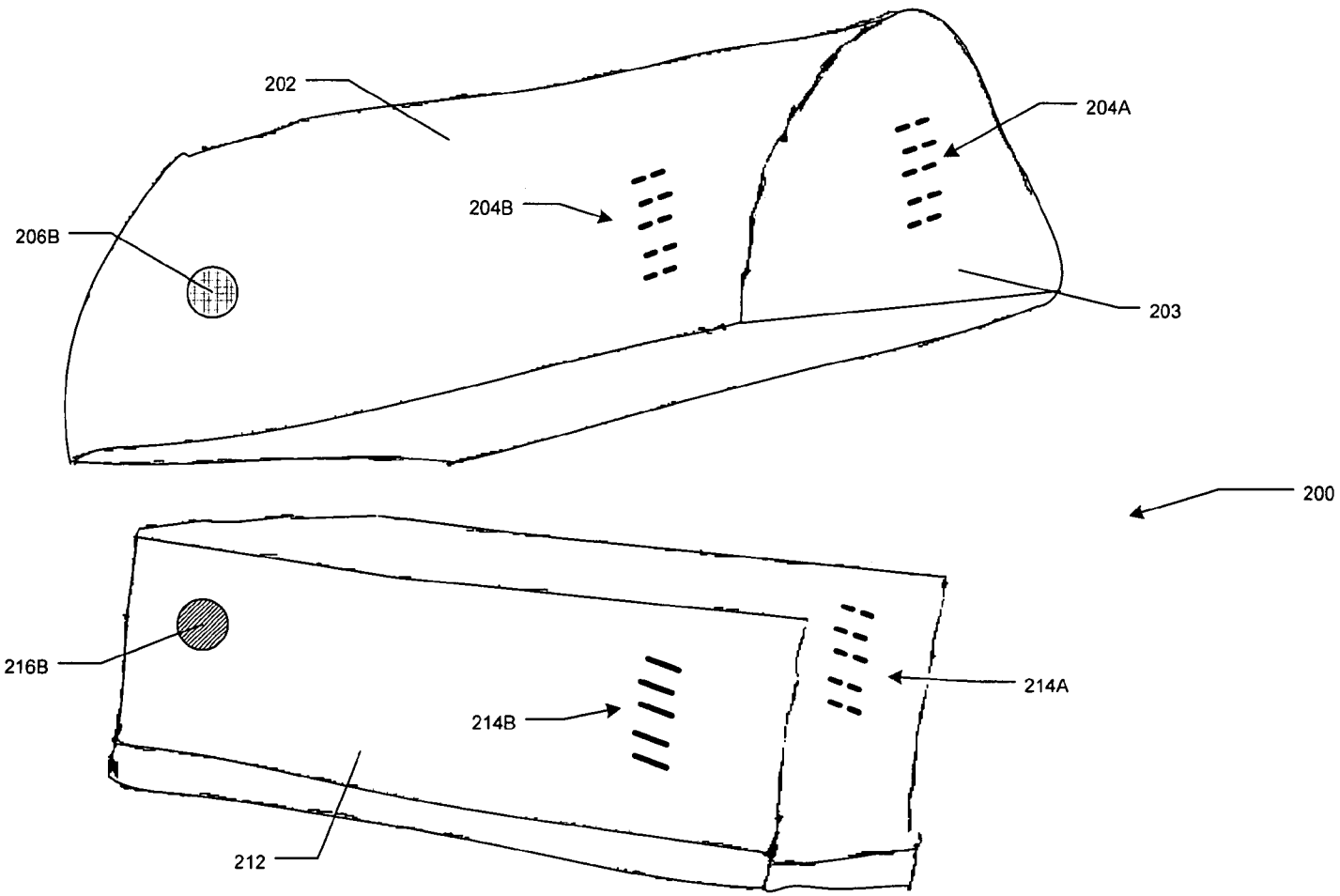
FIG. 2 shows an exploded view of an upward opening mailbox according to another embodiment of the present invention.

FIG. 2 shows an alternative embodiment of an upward opening mailbox 200. In this embodiment, mailbox 200 includes an upper shell 202 and a lower housing portion 212. The upper shell 202 has a front sealing portion 203, inwardly protruding rib portions 204A, 204B and inwardly projecting first (not shown) and second (206B) male pivot members. Lower housing 212 has first (not shown) and second (216B) pivot openings for pivotally connecting to male pivot members 206. It also has outward projecting rib portions 214A, 214B for cooperating with rib portions 204A, 204B to maintain the upper shell 202 in a stable (open or closed) position. Unlike with the mailbox of FIG. 1, lower housing 212 not only has a front opening, but also, it has an opening on its upper surface (the entire upper surface in the depicted embodiment) thereby making it easier to insert and remove items into and out of the lower housing 212.

With both of these embodiments, the upper shell substantially envelops the lower housing (with the exception of the lower housing's lower plane). This results in at least two benefits. First, the housing opening—regardless of whether it faces outwardly, upwardly, or both outwardly and upwardly—sufficiently covers the opening without any seams or cracks exposed to downwardly or laterally projecting rain or snow. Second, it results in a more stable construction for keeping the opening sealed (or covered). The shell conforms about multiple sides of the housing, which provides an inherently solid, stable rotatable coupling of the shell to the housing.

Although the invention has been described with reference to specific examples, it would be appreciated by those skilled in the art that the invention may be embodied in many other forms. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim:

1. A rural mailbox apparatus, comprising:

a lower housing having an opening for passing mail into and out of the housing; and an upper shell pivotally connected to said lower housing, said upper shell being vertically rotatably moveable between a lowered, closed position and an upper, open position, wherein the shell substantially envelops the lower housing and sufficiently covers the housing opening to protect contained mail from normal environmental conditions when in the closed position and provides access for a user to deposit mail into or extract mail out of the housing when in the open position; the lower housing includes rib protrusions on an exterior surface thereof which cooperate with rib protrusions on an interior surface of the upper shell to define position holding devices, wherein the cooperating ribs hold the upper shell in either the closed or open positions.

2. The mailbox apparatus of claim 1, wherein the housing opening faces outwardly toward a user in a vehicle that is next to the mailbox apparatus.

3. The mailbox apparatus of claim 1, wherein the upper shell is pivotally connected to the lower housing with spaced apart first and second pivot connections.

4. The mailbox apparatus of claim 1, wherein the lower housing is generally box shaped, and the upper shell generally has the shape of an oblong box with an arcuate top surface.

5. A rural mailbox apparatus, comprising:

a lower, generally boxed shaped housing having an opening for passing mail into and out of the housing, the opening facing outwardly toward a user in a vehicle that is next to the mailbox apparatus;

an upper generally oblong shaped shell with an arcuate upper surface, the shell being pivotally connected to said lower housing, said upper shell being vertically rotatably moveable between a lowered, closed position and an upper, open position, wherein the shell substantially envelops the lower housing and sufficiently covers the housing opening to protect contained mail from normal environmental conditions when in the closed position and provides access for a user to deposit mail into or extract mail out of the housing when in the open position; the lower housing includes rib protrusions on an exterior surface thereof which cooperate with rib protrusions on an interior surface of the upper shell to define position holding devices, wherein the cooperating ribs hold the upper shell in either the closed or open positions.

6. The mailbox apparatus of claim 5, wherein the upper shell is pivotally connected to the lower housing with spaced apart first and second pivot connections.

* * * * *